US007178681B2

(12) United States Patent
Libman

(10) Patent No.: US 7,178,681 B2
(45) Date of Patent: Feb. 20, 2007

(54) DISPLAY RACK CONSTRUCTION

(75) Inventor: Robert Libman, Champaign, IL (US)

(73) Assignee: The Libman Company, Arcola, IL (US)

( * ) Notice: Subject to any disclaimer, the term of this patent is extended or adjusted under 35 U.S.C. 154(b) by 329 days.

(21) Appl. No.: 10/856,463

(22) Filed: May 28, 2004

(65) Prior Publication Data

US 2005/0263466 A1 Dec. 1, 2005

(51) Int. Cl.
*A47F 5/08* (2006.01)

(52) U.S. Cl. ..... 211/106; 211/193; 211/90.03

(58) Field of Classification Search ..... 211/106, 211/106.01, 103, 85.31, 193, 181.1, 133.3, 211/133.5, 90.03, 126.5, 126.9; 248/302, 248/303; D6/566
See application file for complete search history.

(56) References Cited

U.S. PATENT DOCUMENTS 3,659,722 A * 5/1972 Carroll ..... 211/106
4,340,144 A * 7/1982 Cousins ..... 211/106.01
5,031,783 A * 7/1991 Goudreau ..... 211/181.1
5,197,614 A * 3/1993 Dalton et al. ..... 211/133.2
5,482,168 A * 1/1996 Welch et al. ..... 211/106
5,588,543 A * 12/1996 Finger ..... 211/90.01
5,769,248 A * 6/1998 Johnson ..... 211/106
5,855,283 A * 1/1999 Johnson ..... 211/59.3
5,871,115 A * 2/1999 Kohn ..... 220/485
6,299,001 B1 * 10/2001 Frolov et al. ..... 211/106
6,758,355 B2 * 7/2004 Zidek ..... 211/205
2004/0084392 A1 * 5/2004 Richter et al. ..... 211/59.3

OTHER PUBLICATIONS

Libman Rack Assembly Instructions, No. 5000, The Libman Company (1 page).
Libman Rack Assembly Instructions, No. 5000-3W, The Libman Company (2 pages).

* cited by examiner

*Primary Examiner*—Jennifer E. Novosad
(74) *Attorney, Agent, or Firm*—Banner & Witcoff, Ltd.

(57) ABSTRACT

A display rack construction includes at least first and second grid assemblies in combination with a removable bracket assembly. The bracket assembly is designed to functionally join the grid assemblies and simultaneously act to support items for purposes of display. The combination of grid assemblies and bracket assembly provides a self-positioning display rack construction that is generally stable with respect to lateral movement of the individual grid assemblies.

3 Claims, 3 Drawing Sheets

10

16
18
20
50
12
57
52
20'
58
64
13
14
19
18'
17
16'

FIG.4
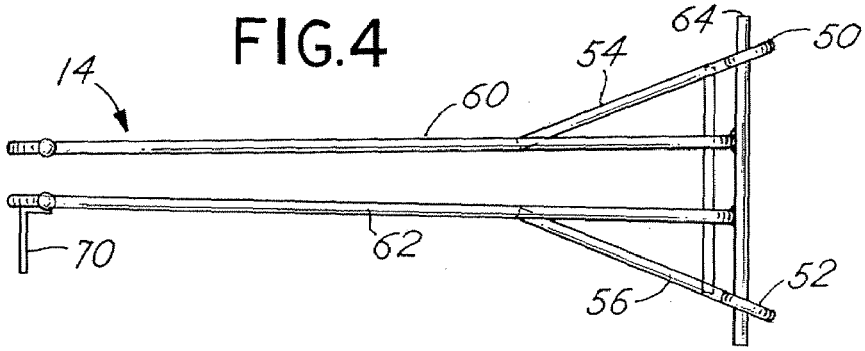
FIG.5
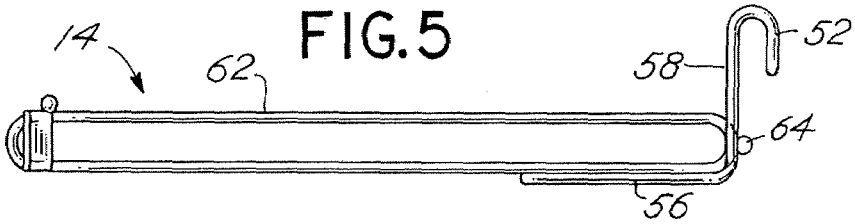
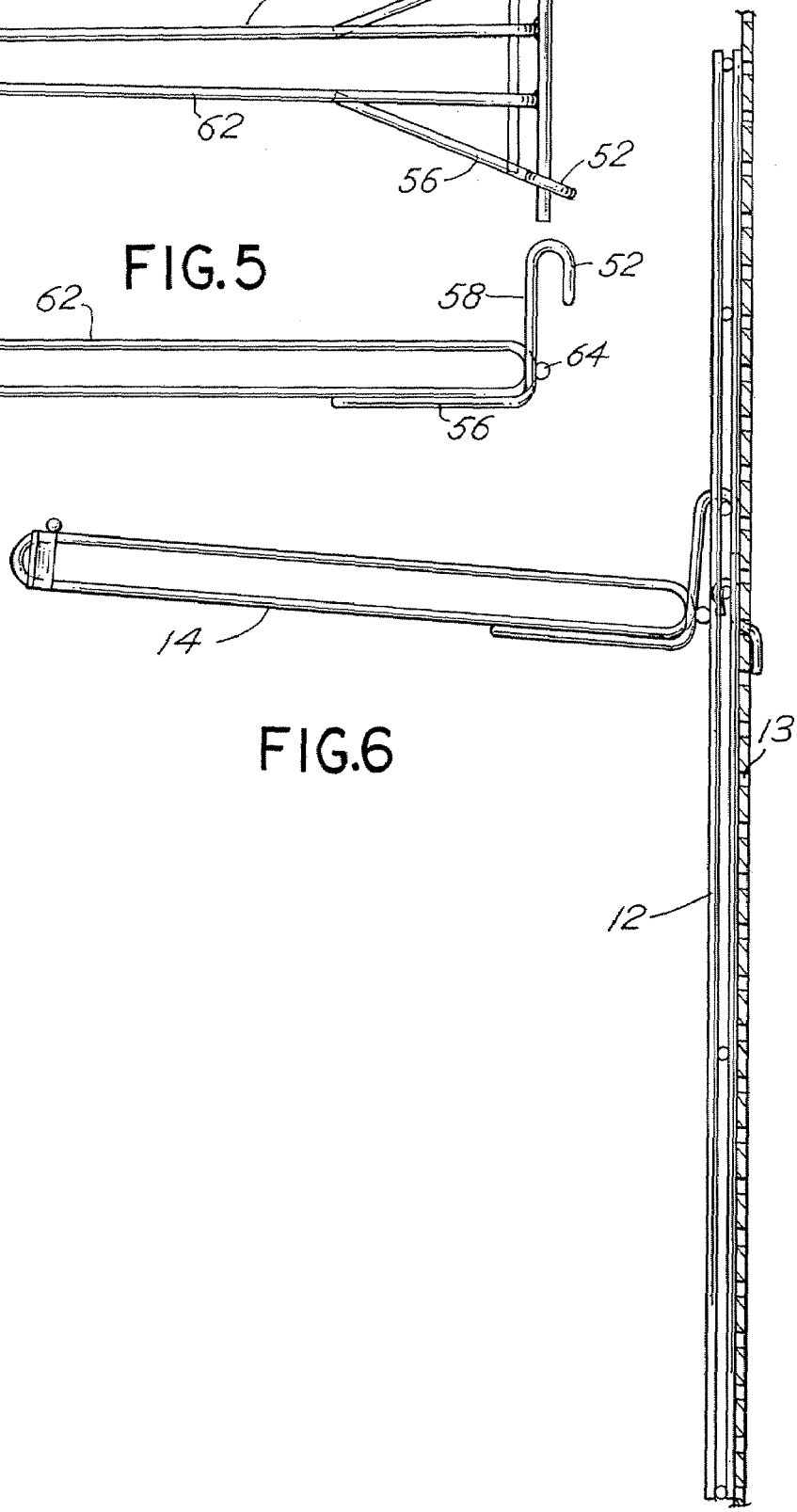
FIG.6

DISPLAY RACK CONSTRUCTION

BACKGROUND OF THE INVENTION

In a principal aspect, various embodiments of the present invention relate to a display rack construction primarily for the display of items having elongated handles, such as brooms, mops and the like.

The on-site display in retail stores of items that have an elongated handle, such as brooms, mops and other cleaning implements, may be effected in a number of ways. For example, the handles may be inserted downwardly into a free-standing bin with the active end of the item projecting upwardly. This manner of display is not favored inasmuch as the labeling for the item is typically upside down and thus difficult to read. Also, such a display technique does not lend itself to ease of access to the displayed item. Further, arrangement of the displayed items can be difficult, resulting in a non-uniform display arrangement that can appear untidy.

Alternatively, the items may be hung by the handle from hooks on a support rack with a wall or aisle display. The items may be hung through holes in their handles or by attached tabs. With this arrangement, it is difficult to remove from the hook any items that are not at the front of the row.

Another manner of displaying such cleaning implements and the like is to provide a rack which supports and aligns the handles, and thus the items, one in front of the other. Such a display rack typically includes a ladder-like rack attached to a vertical support surface and utilizes closely-spaced, parallel guide rods extending therefrom to hold the handles of the items in a linear array. Thus, the first item in the display is easily accessible to the consumer and may be easily removed from the display rack. Additionally, the labeling for the product may be easily viewed.

Although these types of display racks are deemed useful, maintaining the spaced arrangement of the racks while also providing a stable display support may be difficult and require additional mechanical assembly. Display racks of this type generally include a plurality of wall-mounted support racks, or ladders. The ladders are mounted on a vertical support surface side-by-side and spaced apart from adjacent ladders. To improve the stability and strength of the display rack, the ladders are often joined together using brackets or other connectors that extend between the vertical side rods of adjacent ladders. Additionally, when providing such a display rack, the ability to alter the arrangement of the positioning of the displayed items which may vary in size, length and the like is limited by the size and configuration of the ladders.

Thus, there has developed a need to provide a display rack construction that is self-stabilizing. Further, there remains a need for a display rack construction that is easily assembled and disassembled and changeable in assembly and construction in a manner that enables adjustment of the display rack to accommodate items of various sizes and configuration.

SUMMARY OF THE INVENTION

Briefly, the various embodiments of the present invention include a display rack construction which includes at least a first and a second grid assembly. Each of the grid assemblies is comprised of a plurality of rod members which are joined together to form a lattice. Among the rod members are one or more horizontal rods and one or more lateral, or vertical, side rods along each side of the grid assembly.

There is further included in the construction a bracket assembly that simultaneously may engage both the first and second grid assemblies and hold those assemblies juxtaposed in a desired position. Hook members projecting from the bracket assembly engage the horizontal rod members of the respective first and second grid assemblies and effectively interlock with the horizontal rod members to simultaneously support the bracket assembly and securely retain the grid assemblies in their side-by-side position. The combination of grid assemblies and bracket assembly provide a generally stable display rack construction by limiting lateral movement of the grid assemblies and avoids the need for ancillary connectors to secure the side rods of adjacent grid assemblies together is spaced relation. The bracket assembly also includes projecting rod members which extend in a cantilever manner from the hook members and are spaced so as to facilitate the placement between the projecting rod members of handles associated with items to be displayed.

Because the bracket assembly is designed to simultaneously support or engage handle members as well as retain the grid assemblies in position with respect to one another, the bracket assembly may be easily disassembled. As a result, uniform size grid assemblies may be utilized in the manufacture of the display rack. Further, the bracket assembly may be adjusted to engage with variously positioned horizontal rod members associated with the grid assemblies to accommodate various sizes and heights of items maintained in the display rack. Also, multiple bracket assemblies may be used, and the bracket assemblies may be designed to hold, support and/or display a myriad of items of different sizes and shapes, including but not limited to brooms, mops, brushes and the like.

BRIEF DESCRIPTION OF THE DRAWINGS

In the detailed description which follows, reference will be made to the drawings comprised of the following figures:

FIG. 4 is a top plan view of the bracket assembly of the display rack construction of FIG. 1;

FIG. 5 is a side elevational view of the bracket assembly of FIG. 4; and FIG. 6 is a side elevational view of the combination of the bracket assembly and the grid assemblies of FIG. 1.

DETAILED DESCRIPTION OF THE PREFERRED EMBODIMENTS

Figure 1:
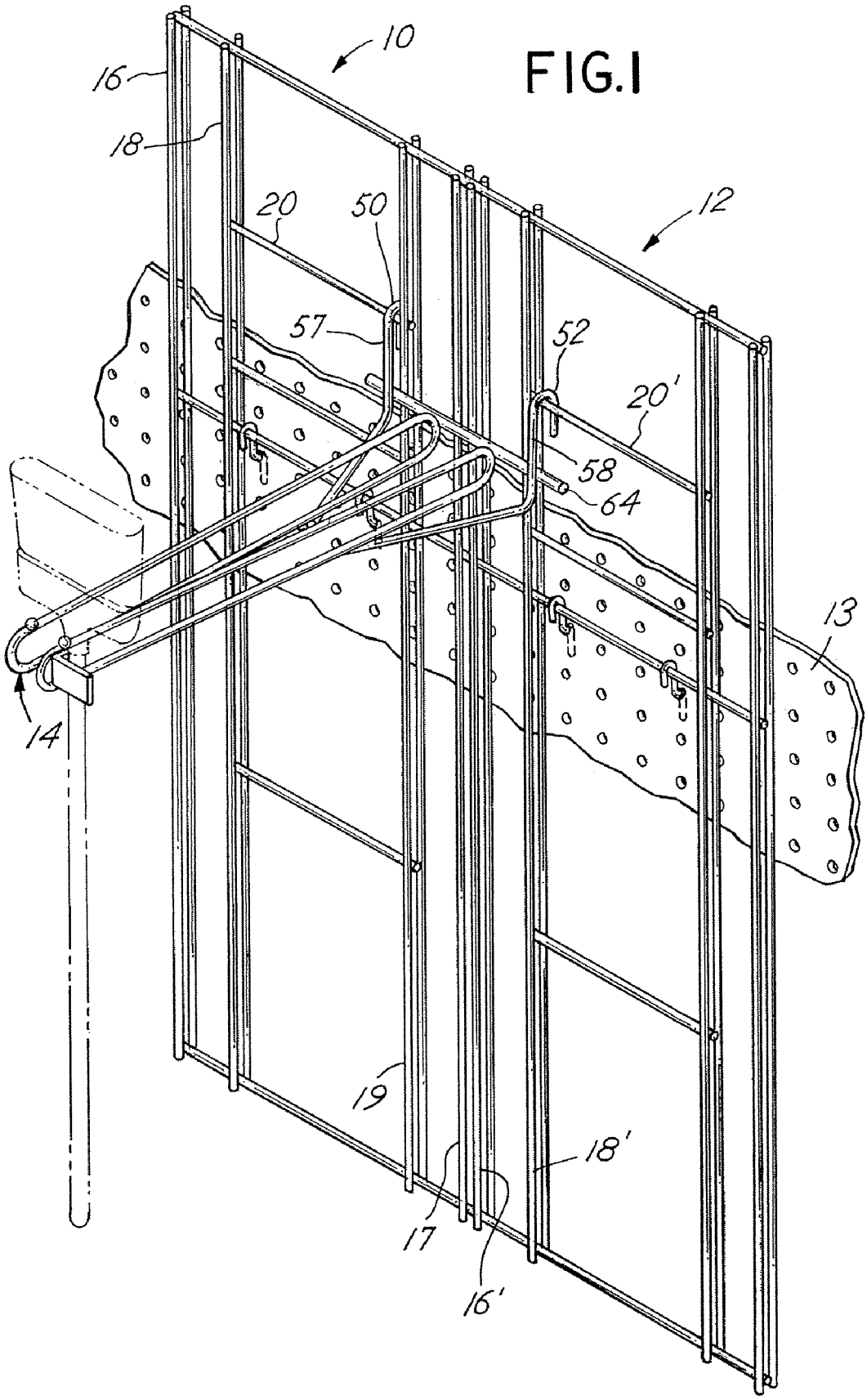
FIG. 1 is a schematic view of a display rack construction in accordance with an embodiment of the present invention, showing a first grid assembly, a second grid assembly and a bracket assembly which retains the grid assemblies in combination and which is designed to support items for display.

Referring to FIG. 1, a typical embodiment of the invention comprises at least a first grid assembly 10 and a second grid assembly 12 supported on a vertical surface 13. In practice, the grid assemblies 10 and 12 are substantially identical in construction. However, the grid assemblies 10 and 12 may be altered in construction so long as essential elements or basic elements associated with the construction are incorporated. Additionally, more than two grid assemblies may be utilized in combination to provide a display rack construction. That is, a grid assembly such as assembly 10 and assembly 12 may be duplicated and utilized in multiple combinations to provide a display rack construction. Thus, grid assemblies having the described elemental features may be joined in multiple grid assembly arrays by appropriate bracket assemblies of the type described hereinafter to provide a display rack construction of any desired size.

The grid assemblies 10 and 12 cooperate with a bracket assembly 14 as described hereinafter. The bracket assembly 14 maintains the grid assemblies 10 and 12 juxtaposed, one with respect to the other, in a desired relation. Typically, that desired relation is a side-by-side array to improve stability by limiting lateral movement of the individual grid assemblies 10 and 12 and to allow items to be displayed conveniently upon the grid assemblies. Multiple bracket assemblies 14 may thus be used to effect such joinder of grid assemblies 10, 12. An additional function of the bracket assembly 14 is to facilitate display of items. In other words, the bracket assemblies 14 themselves engage and support various items for purposes of display. Thus, the simultaneous and dual functions associated with the bracket assemblies 14 is effected.

Figure 2:
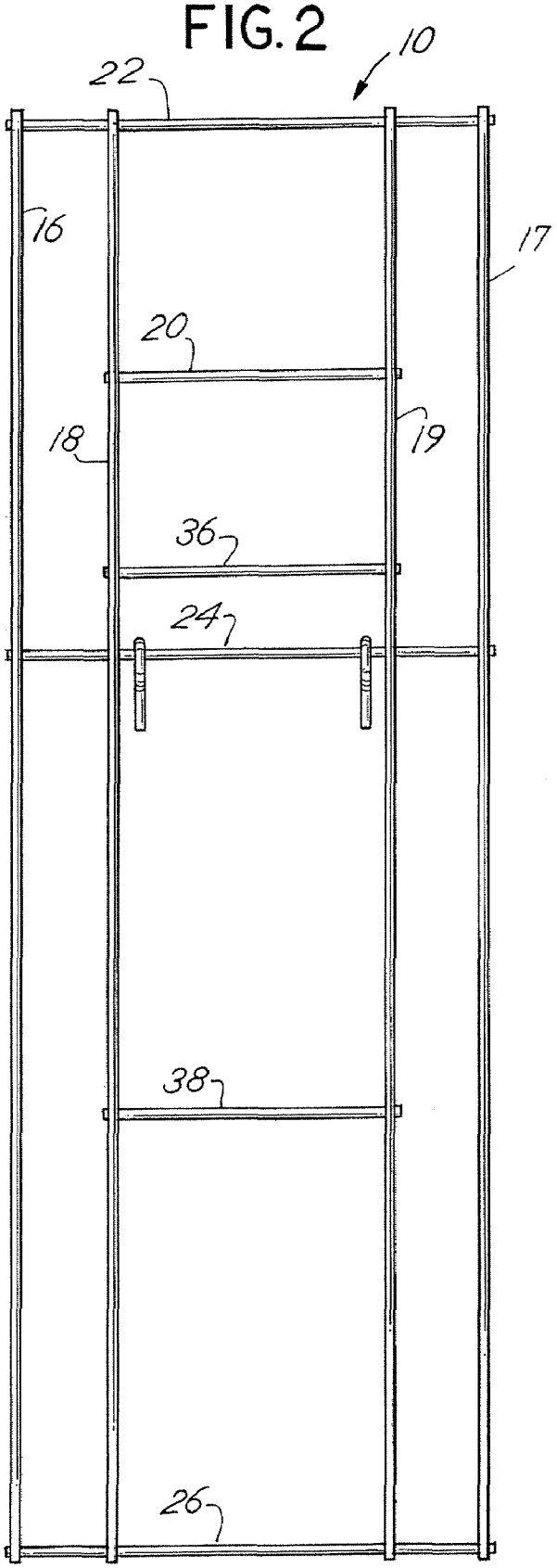
FIG. 2 is a front elevational view of one of the grid assemblies of FIG. 1.
Figure 3:
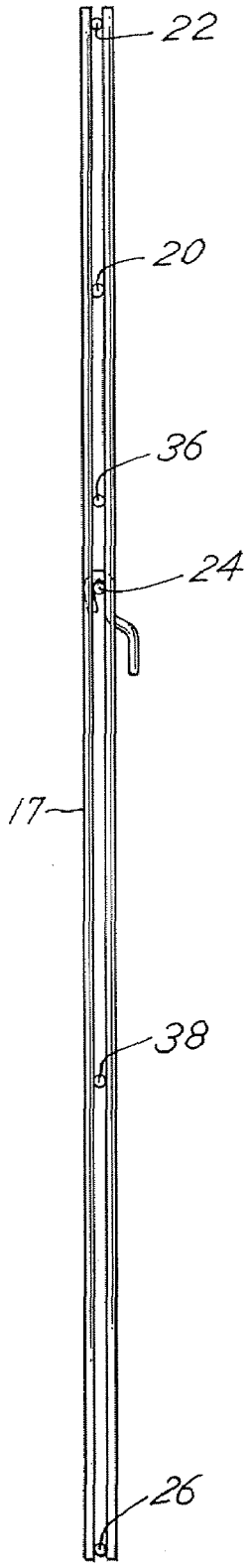
FIG. 3 is a side elevational view of the grid assembly of FIG. 2.

Referring now also to FIG. 2, there is illustrated an individual grid assembly 10, which is further described herein. Although only grid assembly 10 is separately illustrated and described, the description of grid assembly 10 is equally applicable to second grid assembly 12. Further, although in the embodiment illustrated, grid assemblies 10 and 12 are substantially identical, grid assemblies of differing configurations are contemplated for use together. The various rod members forming the lattice of grid assembly 10 are substantially identical in diameter, although rod members of differing diameters also are contemplated as being within the scope of the present invention. Thus, grid assembly 10 includes an outside rod member 16 that is a vertical rod member incorporated as an element of the lattice comprising the grid assembly 10. An inner rod member 18 is spaced horizontally or laterally from the first outside rod member 16. The second rod member 18 is also a vertical rod member. Similarly, the opposite side of the grid assembly 10 includes a second outside rod member 17 and a second inner rod member 19.

Horizontal or cross rod members 22, 24 and 26 define the configuration of the overall grid assembly 10 with respect to both inner members 18 and 19 and outside rod members 16 and 17. The rod members described are joined together to form a frame comprised of the vertical and horizontal rod members. Importantly, the frame includes vertical outside rods 16 and 17 spaced apart from inner rod members 18 and 19. Vertical outside rod members 16 and 17 act as spacers for the inner display grid, maintaining it in a spaced apart position relative to the inner display grids of adjacent grid assemblies. Inner rod members 18 and 19 act as "stops" for the bracket assembly 14 as described hereinafter.

At least one horizontal rod member 20 is provided for joinder of vertical inner rod members 18 and 19. Further, one or more additional horizontal rod members, such as horizontal rod members 36 and 38, may be provided intermediate and along the length of the inner vertical rod members 18 and 19. The inner rod members 18 and 19 in combination with any intermediate horizontal rod members 20, 36 and 38, as well as the portions of cross rod members 22, 24 and 26 spanning between inner members 18 and 19, define the configuration of an inner display grid. Display arms, hooks and the like (not shown) may engage any one or more of rod members 20, 22, 24, 26, 36 and 38 between inner vertical members 18 and 19 and extend outwardly therefrom to provide additional capacity for the display of items from the grid assemblies 10 and 12.

FIGS. 4 and 5 illustrate the bracket assembly 14 in greater detail. Thus, the bracket assembly 14 includes a first downwardly extending hook member 50 and a second downwardly extending hook member 52. Each hook member 50 and 52 includes a downwardly extending or depending run 57 (FIG. 1) and 58 and an inclined forwardly extending brace run 54 and 56. The brace 54 and 56 is connected to a looped rod member 60 and 62. A cross member 64, which is generally horizontal, extends between the hook members 50 and 52 and more particularly between the downward extensions 57 and 58 of the hook members 50 and 52. The cross member 64 connects to the loop 60 and the second loop 62 and also engages rod members 19, 17, 16' and 18' to limit rotational movement in a downward direction when the bracket assembly 14 is engaged with and supported by the grid assemblies 10 and 12 (as illustrated in FIG. 1). In this manner, a bracket assembly 14 is provided with spaced parallel loops 60 and 62 to support items such as cleaning implements with elongated handles. The loops 60 and 62 are spaced one from the other and extend outwardly so that handles of brooms, mops and the like may be arranged in linear array therebetween as depicted by the broom shown in broken lines in FIG. 1. An auxiliary display sign 70 may be attached by welding or otherwise to one or both of the loops 60 or 62 to facilitate the use of the bracket assembly 14 as a display rack item.

Loops 60 and 62 are spaced one from the other for aligning handles of a broom, for example. However, various other types of display elements may be utilized. For example, a single rod may be utilized in lieu of loops 60 and 62 for the hanging of various items for purposes of display. Various other arrangements of loops, hooks and the like may also be used.

Importantly, the hook members 50 and 52 are uniquely spaced one from the other. That is, the hook members 50 and 52 are spaced apart by a distance which is slightly greater than the distance between the inner, or stop, vertical rod members 18' and 19 of the respective grids 12 and 10 as depicted in FIG. 1. In this manner, the hook members 50 and 52 may be inserted over and engaged with the horizontal cross bars 20 and 20' and thus supported by the grid assemblies 10 and 12. Further, the horizontal cross member 64 associated with the bracket assembly 14 preferably extends laterally a distance at least equal to the spacing of the hook members 50 and 52 and preferably a slightly greater distance so that when the hook members 50 and 52 are engaged on horizontal cross members 20 and 20', the cross member 64 can be engaged with vertical rod members 16', 17, 18' and 19 and thus support the bracket assembly 14 as depicted in FIG. 1. The bracket assembly 14 thus extends outwardly in a cantilever-like fashion from the assembled grid assemblies 10 and 12. The parallel rod loops 60 and 62 are maintained in an orientation which enables display of items supported therebetween.

Because the bracket assembly 14 is moveable between various horizontal cross members, e.g. 20, 24, etc., the bracket assembly 14 may be positioned in a manner to facilitate display of items having various sizes or dimensions. Further, the bracket assembly 14 serves the function of maintaining the grid assemblies 10 and 12 properly joined together for purposes of display. As a result, the grid assemblies 10 and 12 may be of dimensions that are easily transported for assembly at a store site. Because the display rack construction does not require use of any particular fasteners, it is easy to assemble and disassemble.

The specific construction of the lattice work or grid assemblies 10 and 12 may be varied. Importantly, the spacing of hook members 50 and 52 in combination with the vertical rods or other elements which act as stop members further in combination with lateral side edges of the grid assemblies are important elements of the construction.

Numerous alternatives, modifications and variations of the display rack construction are possible. Thus, modifications and variations in the practice of the invention are expected to be apparent to those skilled in the art upon consideration of the foregoing detailed description of the invention. Although preferred embodiments have been described above and illustrated in the accompanying drawings, there is no intent to limit the scope of the invention to these or any other particular embodiments. Consequently, any such modifications and variations are intended to be included within the scope of the following claims.

What is claimed is:

1. A display rack construction comprising, in combination:

a first grid assembly including a plurality of rod members joined to form a first generally vertical support lattice, said first lattice including a first generally horizontal bracket support rod, a first generally vertical terminal lateral side edge and a first stop member attached to the first support rod and spaced horizontally from the first lateral side edge;

a second grid assembly including a plurality of rod members joined to form a second generally vertical support lattice, said second lattice including a second generally horizontal bracket support rod, a second generally vertical terminal lateral side edge for positioning parallel against the first lateral side edge and a second stop member attached to the second support rod and spaced horizontally from the second lateral side edge;

a bracket assembly for simultaneously engaging the first and second grid assemblies and holding said grid assemblies in a side by side array with their terminal side edges in substantial engagement, said bracket assembly including a first hook member for looping over and engaging said first bracket support rod and a second hook member spaced horizontally from the first hook member for looping over and engaging said second bracket support rod, said first hook member and second hook member spaced horizontally slightly greater than the horizontal spacing of the first and second stop members to thereby retain the grid assemblies joined in side by side array, said bracket assembly further including a cross member between the hook members, and a cantilever product retention support extending outwardly from and attached to the hook members, said cross member positioned to engage the lateral side edges of the grid assemblies for maintaining the cantilever support extended outwardly from the grid assemblies.

2. The display rack construction of claim 1 wherein the grid assemblies each comprise a rectangular array of connected rods comprising the horizontal support rod, the lateral side edge and the stop member.

3. The display rack construction of claim 1 wherein the cantilever product retention support comprises spaced projecting, generally horizontal rod assemblies for supporting the handles of a cleaning utensil.

* * * * *